US006921252B2

(12) United States Patent
Mehus et al.

(10) Patent No.: US 6,921,252 B2
(45) Date of Patent: Jul. 26, 2005

(54) HYDRAULIC PUMP DRIVEN BY CYCLIC PRESSURE

(75) Inventors: Richard J. Mehus, Richfield, MN (US); John E. Thomas, River Falls, WI (US)

(73) Assignee: Ecolab Inc., Mendota Heights, MN (US)

( * ) Notice: Subject to any disclaimer, the term of this patent is extended or adjusted under 35 U.S.C. 154(b) by 214 days.

(21) Appl. No.: 10/390,452

(22) Filed: Mar. 17, 2003

(65) Prior Publication Data

US 2004/0184933 A1 Sep. 23, 2004

(51) Int. Cl.[7] ..... F04B 45/073
(52) U.S. Cl. ..... 417/394
(58) Field of Search ..... 417/383, 394, 417/395

(56) References Cited

U.S. PATENT DOCUMENTS

| | | | | | |
|---|---|---|---|---|---|
| 2,984,188 | A | * | 5/1961 | Tuckey et al. | 417/394 |
| 3,304,881 | A | * | 2/1967 | Grise | 417/394 |
| 3,957,401 | A | * | 5/1976 | Sweeney et al. | 417/395 |
| 4,111,613 | A | * | 9/1978 | Sperry | 417/394 |
| 4,184,811 | A | * | 1/1980 | Schade | 417/394 |
| 4,810,172 | A | * | 3/1989 | Fiedler et al. | 417/394 |
| 5,174,732 | A | * | 12/1992 | Hoya | 417/394 |
| 5,601,101 | A | | 2/1997 | Grapes et al. | 134/56 |
| 5,772,412 | A | | 6/1998 | Zytynski | 417/393 |
| 5,791,882 | A | | 8/1998 | Stucker et al. | 417/269 |
| 5,934,886 | A | * | 8/1999 | Bushnell | 417/395 |
| 6,048,183 | A | | 4/2000 | Meza | 417/569 |
| 6,162,027 | A | | 12/2000 | Tuell | 417/394 |
| 6,554,587 | B2 | | 4/2003 | Paolini et al. | 417/413.1 |
| 6,554,589 | B2 | | 4/2003 | Grapes | 417/477.12 |
| 6,733,252 | B2 | * | 5/2004 | Feygin et al. | 417/394 |

* cited by examiner

*Primary Examiner*—Michael Koczo, Jr.
(74) *Attorney, Agent, or Firm*—Merchant & Gould P.C.

(57) ABSTRACT

A hydraulic pump for injecting a predetermined amount of a fluid product into a line carrying fluid that is subject to cyclic pressure. A chamber has a rigid outer wall adapted to be fluidly coupled to the line. A flexible bladder positioned within the chamber forms a cavity between the bladder and the outer wall of the chamber. The outer wall of the chamber has a first opening and a second opening, both the first opening and the second opening being in fluid communication with the cavity, the first opening adapted to be fluidly coupled to the fluid product, the second opening adapted to be fluidly coupled to the line. The flexible bladder is responsive to fluid pressure in the chamber by moving toward the outer wall of the chamber under a relatively high pressure from the fluid from the line and rebounding to a predetermined position away from the outer wall of the chamber when under a relatively low pressure from the fluid from the line. A first one-way check valve is in fluid communication between the fluid product and the first opening allowing the fluid product to pass only into the cavity from outside of the chamber. A second one-way check valve in fluid communication between the second opening and the line allowing the fluid product to pass only from the cavity to the line.

19 Claims, 4 Drawing Sheets

HYDRAULIC PUMP DRIVEN BY CYCLIC PRESSURE

TECHNICAL FIELD

This invention relates to hydraulic pumps and, more particularly, to hydraulic pumps that are driven by cyclic pressure from a fluid source.

BACKGROUND

It is common to need to deliver a fluid product to a destination through the use of a pump. Of course, many varieties of hydraulic pumps exist for this purpose. Many of these hydraulic pumps are driven by electricity or another external power source.

In certain circumstances, it is necessary to be able to deliver a precise amount of fluid product to a fluid supply line without a power source other than the fluid supply line itself. This is possible in the situation where the fluid supply line, or fluid line, has a variation in pressure and the fluid product to be delivered can be injected in concert with such variations in fluid line pressure.

This may be necessary, for example, for a washing machine, such as a commercial dishwashing machine, which undergoes repeated fill and drain cycles over time. First, such washing machine may fill with water from a supply line under pressure for a wash cycle. Typically, detergent of some type is added to the water during this cycle. Once full, pressure in the water supply line is reduced, or eliminated, due to the shut-off of a water fill valve, which isolates the water supply line to the dishwasher from the external water supply system. After the wash cycle is complete and the machine has been allowed to drain, or has been pumped out, the machine may again fill with water from water from a, typically the same, supply line by increasing the pressure in the line. This is typically done with a fill valve that regulates pressure in the water supply line. The water used in this cycle could be for a rinse. Typically, it is desirable to add a rinse aid agent to the water in the machine during the rinse cycle. These cycles could be repeated as repeated loads of dishes are processed through the machine. Of course, the two cycles, one wash and one rinse, is merely exemplary. More than one wash cycle could be used. More than one rinse cycle could be used. And additional cycles or different cycles could be used. The constant important item is the need to add some product, e.g., detergent or rinse aid agent, to the water during a given cycle and the water used in the machine came from supply line with cyclic pressure (due to the need to repeatedly fill and drain the machine).

At the same time, such washing machines may not come equipped with equipment to automatically add a precise amount of such products appropriately for each cycle. Adding such automatic equipment to existing machines is difficult, in part because of the difficulty of obtaining an electrical power source and, even if available, an electrical hydraulic pump adds to the complexity, cost and detracts from the reliability of such machine. Even if such washing machines were initially equipped with such automatic equipment, again it would add to the complexity and cost and detract from the reliability of the machine to use an electrically powered hydraulic pump.

Unfortunately, there have not been too many options available.

One type of self-powered, i.e., powered from cyclic pressure of the supply line itself, hydraulic pump makes use of a Bellofram™ diaphragm and an internal spring in a mechanically complicated mechanical hydraulic pump. Such a pump has been used by Ecolab, Inc., St. Paul, Minn., in a pump system known as an Eco-Vac™ pump. While this hydraulic pump system works well, it is significantly complicated and significantly expensive.

SUMMARY OF THE INVENTION

The present invention provides a simpler, less expensive, self-powered hydraulic pump that delivers a precise amount of fluid product to a supply, using the cyclic pressure from the very supply line into which the fluid product is to be injected. The pump is relatively uncomplicated and uses no other power source, such as electricity.

In one embodiment, the present invention provides a hydraulic pump for injecting a predetermined amount of a fluid product into a line carrying fluid that is subject to cyclic pressure. A chamber has a rigid inner wall adapted to be fluidly coupled to the line. A flexible bladder positioned within the chamber forms a cavity between the bladder and the inner wall of the chamber. The chamber has a first opening and a second opening, both the first opening and the second opening being in fluid communication with the cavity, the first opening adapted to be fluidly coupled to the fluid product, the second opening adapted to be fluidly coupled to the line. The flexible bladder is responsive to fluid pressure in the chamber by moving toward the inner wall of the chamber under a relatively high pressure from the fluid from the line and rebounding to a predetermined position away from the inner wall of the chamber when under a relatively low pressure from the fluid from the line. A first one-way check valve is in fluid communication between the fluid product and the first opening allowing the fluid product to pass only into the cavity from outside of the chamber. A second one-way check valve in fluid communication between the second opening and the line allowing the fluid product to pass only from the cavity to the line.

In a preferred embodiment, the cavity has a volume determined by a space formed between the bladder and the inner wall under the relatively low pressure from the fluid from the line. An adjustable member has the ability to force a selected portion of the bladder toward the inner wall of the chamber regardless of pressure from the fluid from the line, allowing the bladder to only partially rebound thereby adjustably limiting the volume of the cavity.

In a preferred embodiment, the cavity has a volume determined by a space formed between the bladder and the inner wall under the relatively low pressure from the fluid from the line and the chamber further has an adjustment port. An adjustable member is fitted to the adjustment port having the ability to force a selected portion of the bladder toward the inner wall of the chamber regardless of pressure from the fluid from the line, allowing the bladder to only partially rebound thereby adjustably limiting the volume of the cavity.

In a preferred embodiment, the cavity has a volume determined by a space formed between the bladder and the inner wall under the relatively low pressure from the fluid from the line and the chamber further has an adjustment port. A screw, fitted to the adjustment port, is externally adjustable with respect to the chamber and having external threads inside the chamber. A piece having internal threads mating with the external threads of the screw is adapted to force a selected portion of the bladder toward the inner wall of the chamber thereby selectively adjusting the volume of the cavity.

In a preferred embodiment, the cavity has a volume determined by a space formed between the bladder and the inner wall under the relatively low pressure from the fluid from the line and the chamber further has an adjustment port. A screw, fitted to the adjustment port, is externally adjustable with respect to the chamber and having split, oppositely oriented, external threads inside the chamber. A first piece having internal threads mating with one set of the split external threads of the screw is adapted to force a first selected portion of the bladder toward the inner wall of the chamber. A second piece having internal threads mating with another set of the split external threads of the screw is adapted to force a second selected portion of the bladder toward the inner wall of the chamber. In this manner, the first piece and the second piece cooperate in response to the screw to selectively adjust the volume of the cavity.

In an alternative embodiment, the present invention provides a hydraulic pump for injecting a predetermined amount of a fluid product into a line carrying fluid that is subject to cyclic pressure. A chamber is adapted to be fluidly coupled to the line, the chamber having a rigid outer and a rigid inner wall. A flexible bladder positioned within the chamber forms a cavity between the bladder and the inner wall of the chamber. The chamber has a first opening and a second opening, both the first opening and the opening being in fluid communication with the cavity. The flexible bladder is responsive to fluid pressure in the chamber by expanding toward the inner wall of the chamber when under a relatively high pressure from the fluid from the line and rebounding to a predetermined position away from the inner wall of the chamber when under a relatively low pressure from the fluid from the line. A first conduit is coupled to the first opening and adapted to be coupled to the fluid product. A second conduit has one end coupled to the second opening and has another end fluidly coupled to the line. A first one-way check valve is in fluid communication between the fluid product and the first opening allowing the fluid product to pass only into the cavity from outside of the chamber. A second one-way check valve is in fluid communication between the second opening and the line allowing the fluid product to pass only from the cavity to the line.

In a preferred embodiment, a nipple fluidly couples the chamber to the line, the nipple having an orifice accommodating the second conduit from the second opening to the line.

In a preferred embodiment, the orifice is adjustable regulating a rate at which the fluid product can be added to the fluid in the line.

In a preferred embodiment, the nipple has a first passage fluidly coupling the line to the chamber and a second passage fluidly coupling the orifice and the line.

In a preferred embodiment, the first passage is separate from the second passage.

In a preferred embodiment, the fluid in the line has a direction of flow under the relatively high pressure, the first passage communicates with the line in an upstream direction with respect to the direction of flow and the second passage communicates with the line in a downstream direction with respect to the direction of flow.

In a preferred embodiment, the first one-way check valve is positioned within the first opening and wherein the second one-way check valve is positioned within the second opening.

In a preferred embodiment, the bladder moves against inner wall of the chamber under the relatively high pressure.

Also, in a preferred embodiment, the bladder is constructed substantially of ethylene propylene.

Also, in a preferred embodiment, the bladder moves against inner wall of the chamber under the relatively high pressure.

Also, in a preferred embodiment, the relatively high pressure is within the range of five (5) to eighty (80) pounds per square inch.

DETAILED DESCRIPTION

Hydraulic pump 10 operates by injecting a fluid product 12 into a fluid 14 which is subject to cyclic pressure, meaning that fluid 14 is sometimes under a relatively high pressure and at other times is under a relatively low pressure. Thus, the pressure cycles from periods of relatively high pressure and periods of relatively low pressure. It does not mean the cycle is regular or has a particular pattern. The changes in pressure of fluid 14 power hydraulic pump 10.

An example of fluid 14, which undergoes cyclic changes in fluid pressure, is water in a water line 16 coupled to a commercial dishwasher. The dishwasher goes through various cycles as it conducts the dishwashing operation. For example, the dishwasher may first fill with water and conduct a wash cycle. Following the wash cycle, the dishwasher may drain and prepare for the next cycle. The dishwasher may then fill again and conduct a rinse cycle. Following the rinse cycle, the dishwasher will again drain.

As the dishwasher fills, a fill valve will open to create pressure in a water line 16 to the dishwasher. The water line 16, in turn, is coupled to a typical water supply line commonly found in establishments. With the fill valve open, the water in water line 16 will be under the same, or similar, pressure as the pressure in the traditional water supply line to which it is connected. Water flows through water supply line 16 filling the dishwasher. After the dishwasher fills, the fill valve is closed shutting off further water supply to the dishwasher and causing pressure in water line 16 to fall. With the fill valve closed and no other impetus to cause pressure, the pressure on water in water line 16 will fall to zero, or near zero. With the fill valve closed and pressure on water in water line 16 at zero or near zero, the dishwasher will conduct the operation for the particular cycle for which the water was obtained. As an example, the dishwasher may fill with water for a rinse cycle.

Following completion of the dishwasher operation for which the water was obtained, a pump will typically remove the water from the interior of the dishwasher. The dishwasher may then continue through other cycles by opening the fill valve, pressurizing water line 16 and filling with water. And this cycle can be repeated as needed for the operation of the dishwasher.

Figure 1:
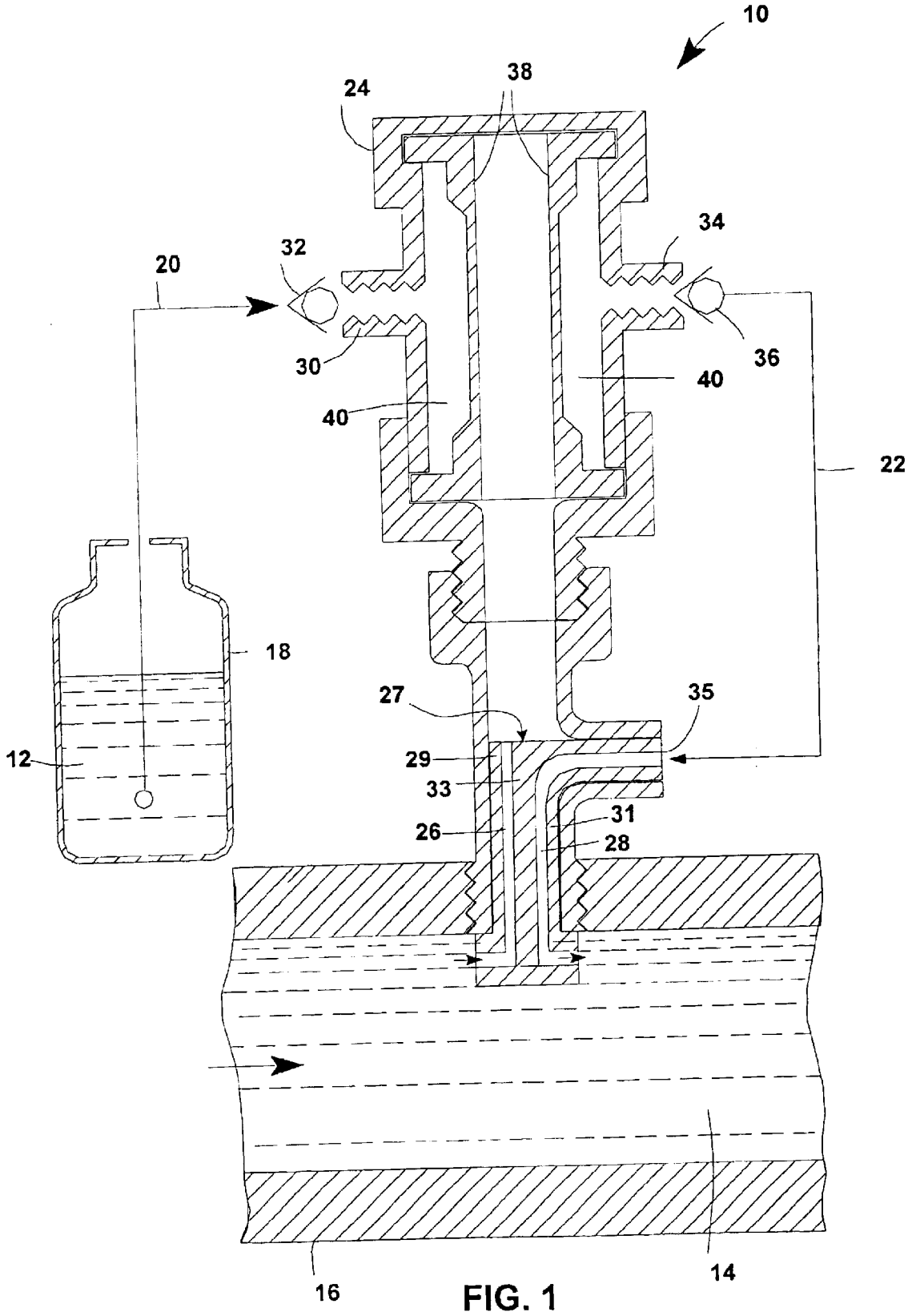
FIG. 1 is a cross-sectional view of an embodiment of the hydraulic pump of the present invention shown coupled to a supply line subject to repeated cyclic pressure.

FIG. 1 illustrates one embodiment of the present invention. Hydraulic pump 10 is attached to fluid line 16 containing fluid 14, in this case water, flowing from left to right in the illustration. Fluid product 12 is contained in container 18 and coupled, via conduit 20, to hydraulic pump 10. Hydraulic pump 10 is also coupled, via conduit 22, back to fluid line 16. Coupled in this manner, hydraulic pump 10 operates to inject fluid product 12 contained in container 18 into fluid 14 contained in fluid line 16 using the cyclic pressure in fluid 14 and even though fluid 14 is under pressure.

Rigid walled chamber 24 is coupled to a side wall of fluid line 16. The chamber includes a nipple 27 that fluidly couples the chamber 24 to the fluid line 16. In an embodiment, the nipple 27 includes two side portions 29 and 31 and a middle portion 33, thereby forming ports, or passages. 26 and 28 through which fluid passes between the fluid line 16 and the chamber 24. Pressurized fluid 14 is allowed to enter chamber 24 through port 26. Fluid product 12 is injected into fluid 14 in fluid line 16 through port 28. Conduit 20, through which fluid product 12 is transported to hydraulic pump 10 from container 18, is connected to chamber 24 at opening 30. One-way check valve 32, positioned in opening 30, allows fluid product 12 to enter chamber 24 but does not allow fluid to return from chamber 24 to container 18. Conduit 22, through which fluid product 12 is transported from hydraulic pump 10 to fluid line 16, is connected to chamber 24 at opening 34. One-way check valve 36, positioned in opening 34, allows fluid product 12 to leave chamber 24 via conduit 22 but does not allow fluid to return to chamber 24. The other end of conduit 22 is fluidly coupled to port 28, and thus to the fluid line 16, by way of an orifice 35 in the nipple 27.

Pumping action for hydraulic pump 10 is provided by flexible bladder 38 contained in chamber 24. Flexible bladder 38, in a relaxed state, has a form that creates cavity 40 between flexible bladder 38 and the inner wall of chamber 24. Cavity 40 is in fluid communication with opening 30 and opening 34. Since fluid 14 is allowed to enter chamber 24, fluid 24 will press against flexible bladder 38 when fluid 14 is under a relatively high pressure, such as when fluid 14 in fluid line 16 is filling the dishwasher. Such a relatively high pressure, preferably, can be in the range of five (5) to eighty (80) pounds per square inch, the equivalent of 0.34 BAR to 5.51 BAR). The pressure of fluid 14 in chamber 24 is enough to expand flexible bladder 38 toward the inner wall of chamber 24. In a preferred embodiment, flexible bladder 38 will essentially expand to substantially press against the inner wall of chamber 24 under the relatively high pressure of fluid 14. With flexible bladder 38 moved toward the inner wall of chamber 24, cavity 40 is substantially reduced or essentially eliminated.

When fluid 14 is under relatively low pressure, flexible bladder 38 has rebound characteristics which returns flexible bladder 38 to its relaxed state, recreating cavity 40. Such a relatively low pressure, preferably can be approximately zero (0) pounds per square inch relative to atmosphere. In a preferred embodiment, flexible bladder 38 rebounds to its relaxed under such relatively low pressure from fluid 14 forming cavity 40 in substantially the same size as cavity 40 before flexible bladder 38 was expanded toward the inner wall of chamber 24. That is, in this embodiment, flexible bladder 38 returns to a relatively consistent shape which provides a relatively consistent volume in cavity 40 under such relatively low pressure of fluid 14. Preferably, flexible bladder 38, under relatively low pressure of fluid 14, rebounds to substantially its original shape.

As the pressure of fluid 14 changes from a relatively high pressure to a relatively low, such as when the fill valve of a dishwasher is closed and the dishwasher stops filling, flexible bladder 38 rebounds from its relatively expanded state to its relaxed state recreating cavity 40. As cavity 40 is recreated, fluid product 12 from container 18 is drawn through conduit 20 and one-way check valve 32 into cavity 40. Once fluid product 12 is in cavity 40, one-way check valve 32 prevents fluid product 12 from returning to container 18.

As the pressure of fluid 14 then changes from a relatively low pressure to a relatively high pressure, such as when the fill valve of the dishwasher is open and the dishwasher begins to fill with fluid 14, flexible bladder 38 is expanded toward the inner wall of chamber 24, reducing or substantially eliminating cavity 40. As cavity 40 is reduced or substantially eliminated, there is no place for fluid product 12 captured in cavity 40 to go except out through opening 34 and one-way check valve 36 and conduit 22 to fluid line 16. Fluid product 12 is preventing from returning to cavity 40 (and chamber 24) by one-way check valve 36.

With cyclic changes in pressure of fluid 14 in fluid line 16, it can be seen that fluid product 12 is effectively pumped from container 18 through hydraulic pump 10 into fluid 14 in fluid line 16. Cavity 40, formed between flexible bladder 38 and the inner wall of chamber 24, alternately fills and then releases fluid product 12 to fluid line 16.

In fact, hydraulic pump 10 operates to pump a known amount of fluid product 12 into fluid 14 in fluid line 16 each time that fluid 14 cycles between relatively low and high pressures. Each pressure cycle causes cavity 40 to engorge and disgorge an amount of fluid product 12.

Providing that flexible bladder 38 is properly constructed by having a proper consistent rebound characteristic to form a relatively consistent volume in cavity 40 upon each return to relatively low pressure of fluid 14, a very precisely known amount of fluid product 12 is injected into fluid 14 for pressure cycle of fluid 14.

Figure 2:
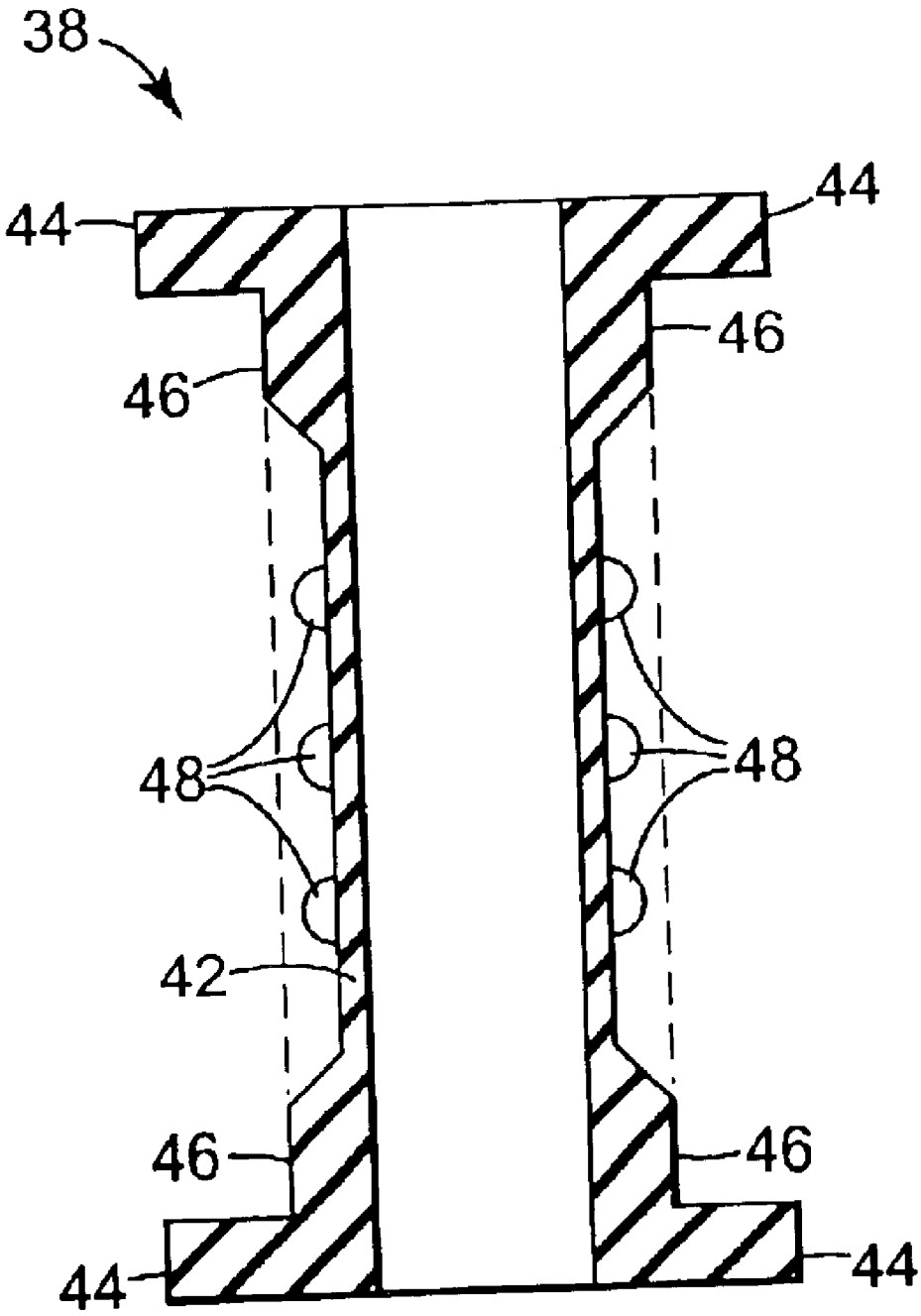
FIG. 2 is a close-up view of a flexible tube used in the hydraulic pump illustrated in FIG. 1.

FIG. 2 illustrates a cross-sectional view of flexible bladder 38. Flexible bladder 38 is a tube 42 having flanges 44 at each end with shoulder 46 between tube 42 and flanges 44. The interior diameter of tube 42 is one-half (0.5) inch (1.27 centimeters). Flexible bladder 38 is approximately 2.5 inches (6.35 centimeters) long. Tube 42 portion of flexible bladder 38 has an outside diameter of 0.625 inches (1.59 centimeters). Shoulders 46 have an outside diameter of ⅞ inch (2.22 centimeters). Tube 42 portion of approximately 1.5 inches (3.81 centimeters) long between shoulders 46. The outside diameter of flanges 44 is 1⅜ inch (3.49 centimeters). Examples of flexible materials having rebound that could be used for flexible bladder 38 are silicone and natural rubber. In a preferred embodiment, flexible bladder 38 is formed from EPDM, a combination of natural rubber and ethylene propylene. EPDM, otherwise known as ethylene propylene dimonomer, is a terpolymer elastomer and is made from ethylene-propylene diene monomer. It can stand up to a variety of bases, alcohols and oxidizing chemicals. It can be used with water, chlorinated water, dilute acids, alkalines and ozone. It has a negligible absorption rate and is not susceptible to swelling.

The outside diameter of flanges 44 contacts the inside of the outside wall of chamber 24 when flexible bladder 38 is positioned within chamber 24. With shoulders 46 and tube 42 having smaller outside diameters than the outside diameter of flanges 44, a space is created when flexible bladder 38 is inserted into chamber 24. It is this space, created with flexible bladder 38 that, in its relaxed or rebound state, creates the volume of cavity 40.

Ribs 48 may be used to help the rebound characteristics of flexible bladder 38.

Figure 3:
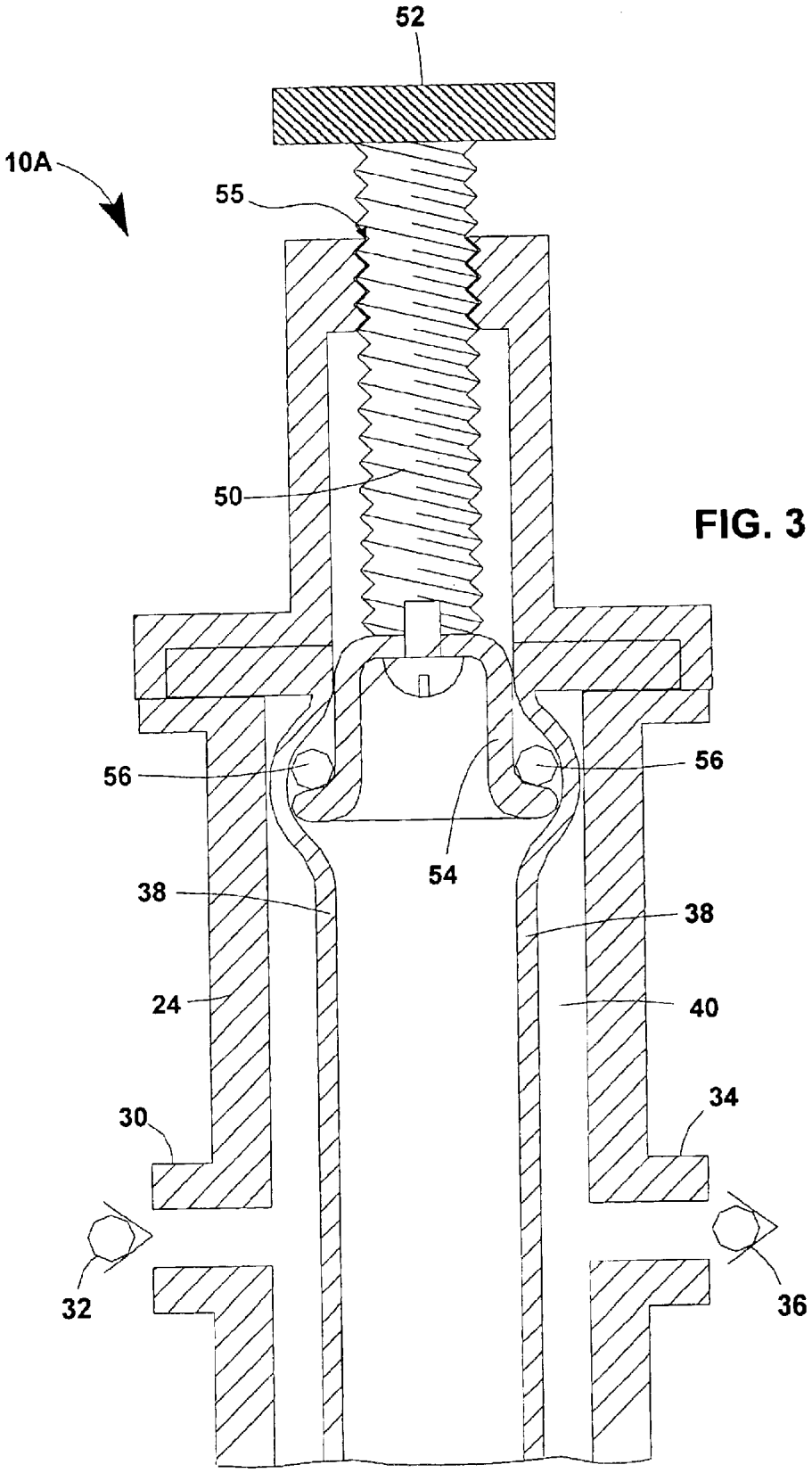
FIG. 3 is a cross-section view of an alternative embodiment of the hydraulic pump of the present invention with a volume adjustment mechanism.

FIG. 3 illustrates an alternative embodiment of a portion of hydraulic pump 10A. Portions of hydraulic pump 10A which are not illustrated in FIG. 3 are identical to the portions of hydraulic pump 10 illustrated in FIG. 1.

Hydraulic pump 10A has cavity 40 which is adjustable in volume. By making cavity 40 adjustable in volume, the precise amount of fluid product 12 that is injected into fluid 14 each pressure cycle can be easily varied.

The top portion of chamber 24 contains an adjustment port 55 in which is fitted a screw 50 having an external thumbwheel 52. By turning thumbwheel 52, screw 50 can easily be adjusted extending more or less into chamber 24. Guides 54 press against the inside wall of flexible bladder 38 forcing flexible bladder 38 outward towards or against the inner wall of chamber 24 at a point that depends upon the amount that screw 50 extends into chamber 24. 0-rings 56 seal fluid 14 from exiting chamber 24. If screw 50 is turned such that screw 50 extends only a small amount into chamber 24, then guides 54, and o-rings 56, will press against flexible bladder 38 only a small amount down from the top, allowing a relatively large cavity 40. However, if screw 50 is turned such that screw 50 extends a relatively large amount into chamber 24, then guides 54, and 0-rings 56, will press against flexible bladder 38 a relatively large distance down from the top, allowing a relatively small cavity 40. Thus, the volume of cavity 40 and the amount of fluid product 12 which is injected into fluid 14 can be easily adjusted by thumbwheel 52.

Figure 4:
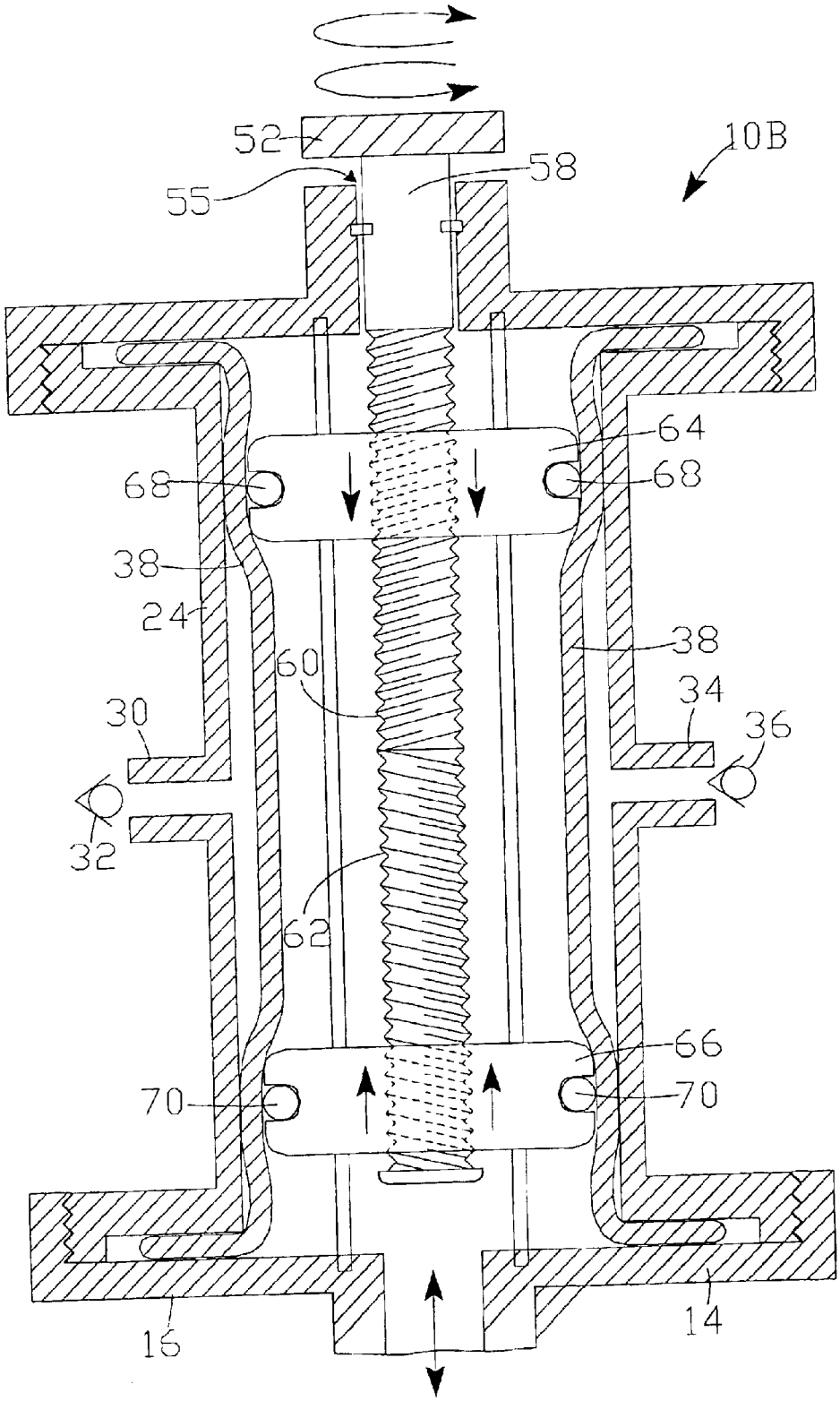
FIG. 4 is a cross-sectional view of another alternative embodiment of the hydraulic pump of the present invention with another volume adjustment mechanism.

FIG. 4 illustrates still another alternative embodiment of a portion of hydraulic pump 10B. Portions of hydraulic pump 10B which are not illustrated in FIG. 4 are identical to the portions of hydraulic pump 10 illustrated in FIG. 1.

In this embodiment, a double-threaded screw 58 having external thumbwheel 52 is fitted to the adjustment port 55. Double-threaded screw 58 has upper threads 60 and lower threads 62 which oppose each other. First guide 64 turns on upper threads 60 of double threaded screw 58 and forces flexible bladder 38 outward towards or against the inner wall of chamber 24 at a point that depends upon the adjustment of double threaded screw 58. Similarly, second guide 66 turns on lower threads 62 of double threaded screw 58 and forces flexible bladder 38 outward towards or against the inner wall of chamber 24 at a point that also depends upon the adjustment of double threaded screw 58. First guide 64 is sealed by o-ring 68. Second guide 66 is sealed by o-ring 70.

As double threaded screw is turned in one direction, first guide 64 moves lower in chamber 24 along flexible bladder 38 and second guide 66 move higher in chamber 24 along flexible bladder 38. As first guide 64 and second guide 66 move toward each other, the available volume for cavity 40 is reduced.

Similarly, as double threaded screw is turned in the other direction, first guide 64 moves higher in chamber 24 along flexible bladder 38 and second guide 66 moves lower in chamber 24 along flexible bladder 38. As first guide 64 and second guide 66 move away from each other, the available volume for cavity 40 is increased.

Thus, the volume of cavity 40 and the amount of fluid product 12 which is injected into fluid 14 can be easily adjusted by thumbwheel 52.

Various modifications and alterations of this invention will be apparent to those skilled in the art without departing from the scope and spirit of this invention. It should be understood that this invention is not limited to the illustrative embodiments set forth above.

What is claimed is:

1. A hydraulic pump for injecting a predetermined amount of a fluid product into a line carrying fluid that is subject to cyclic pressure, comprising:

a chamber having a rigid inner wall adapted to be fluidly coupled to said line;

a flexible bladder positioned within said chamber forming a cavity between said bladder and said inner wall of said chamber;

said chamber having a first opening and a second opening, both said first opening and said second opening being in fluid communication with said cavity, said first opening adapted to be fluidly coupled to said fluid product, said second opening adapted to be fluidly coupled to said line;

said flexible bladder being responsive to fluid pressure in said chamber by moving toward said inner wall of said chamber under a relatively high pressure from said fluid from said line and rebounding to a predetermined position away from said inner wall of said chamber when under a relatively low pressure from said fluid from said line;

a first one-way check valve in fluid communication between said fluid product and said first opening allowing said fluid product to pass only into said cavity from outside of said chamber; and a second one-way check valve in fluid communication between said second opening and said line allowing said fluid product to pass only from said cavity to said line.

2. A hydraulic pump as in claim 1 wherein said cavity has a volume determined by a space formed between said bladder and said inner wall under said relatively low pressure from said fluid from said line, further comprising:

an adjustable member having the ability to force a selected portion of said bladder toward said inner wall of said chamber regardless of pressure from said fluid from said line, allowing said bladder to only partially rebound thereby adjustably limiting said volume of said cavity.

3. A hydraulic pump as in claim 1 wherein said cavity has a volume determined by a space formed between said bladder and said inner wall under said relatively low pressure from said fluid from said line and wherein said chamber further has an adjustment port, further comprising:

an adjustable member fitted to said adjustment port having the ability to force a selected portion of said bladder toward said inner wall of said chamber regardless of pressure from said fluid from said line, allowing said bladder to only partially rebound thereby adjustably limiting said volume of said cavity.

4. A hydraulic pump as in claim 1 wherein said cavity has a volume determined by a space formed between said bladder and said inner wall under said relatively low pressure from said fluid from said line and wherein said chamber further has an adjustment port, further comprising:

a screw, fitted to said adjustment port, externally adjustable with respect to said chamber and having external threads inside said chamber;

a piece having internal threads mating with said external threads of said screw and adapted to force a selected portion of said bladder toward said inner wall of said chamber thereby selectively adjusting said volume of said cavity.

5. A hydraulic pump as in claim 1 wherein said cavity has a volume determined by a space formed between said bladder and said inner wall under said relatively low pressure from said fluid from said line and wherein said chamber further has an adjustment port, further comprising:

a screw, fitted to said adjustment port, externally adjustable with respect to said chamber and having split, oppositely oriented, external threads inside said chamber;

a first piece having internal threads mating with one set of said split external threads of said screw and adapted to force a first selected portion of said bladder toward said inner wall of said chamber; and a second piece having internal threads mating with another set of said split external threads of said screw and adapted to force a second selected portion of said bladder toward said inner wall of said chamber;

whereby said first piece and said second piece cooperate in response to said screw to selectively adjust said volume of said cavity.

6. A hydraulic pump as in claim 1 wherein said bladder is constructed substantially of ethylene propylene.

7. A hydraulic pump as in claim 6 wherein said bladder is constructed substantially of ethylene propylene dimonomer.

8. A hydraulic pump as in claim 1 wherein said bladder moves against inner wall of said chamber under said relatively high pressure.

9. A hydraulic pump as in claim 1 wherein said relatively high pressure is within the range of five (5) to eighty (80) pounds per square inch.

10. A hydraulic pump for injecting a predetermined amount of a fluid product into a line carrying fluid that is subject to cyclic pressure, comprising:

a chamber adapted to be fluidly coupled to said line, said chamber having a rigid inner wall;

a flexible bladder positioned within said chamber forming a cavity between said bladder and said inner wall of said chamber;

said chamber having a first opening and a second opening, both said first opening and said second opening in fluid communication with said cavity;

said flexible bladder being responsive to fluid pressure in said chamber by expanding toward said inner wall of said chamber when under a relatively high pressure from said fluid from said line and rebounding to a predetermined position away from said inner wall of said chamber when under a relatively low pressure from said fluid from said line;

a first conduit coupled to said first opening and adapted to be coupled to said fluid product;

a second conduit having one end coupled to said second opening and having another end fluidly coupled to said line;

a first one-way check valve in fluid communication between said fluid product and said first opening allowing said fluid product to pass only into said cavity from outside of said chamber; and a second one-way check valve in fluid communication between said second opening and said line allowing said fluid product to pass only from said cavity to said line.

11. A hydraulic pump as in claim 10 further comprising a nipple fluidly coupling said chamber to said line, said nipple having an orifice accommodating said second conduit from said second opening to said line.

12. A hydraulic pump as in claim 11 wherein said nipple has a first passage fluidly coupling said line to said chamber and a second passage fluidly coupling said orifice and said line.

13. A hydraulic pump as in claim 12 wherein said first passage is separate from said second passage.

14. A hydraulic pump as in claim 13:

wherein said fluid in said line has a direction of flow under said relatively high pressure;

wherein said first passage communicates with said line in an upstream direction with respect to said direction of flow; and wherein said second passage communicates with said line in a downstream direction with respect to said direction of flow.

15. A hydraulic pump as in claim 10 wherein said first one-way check valve is positioned within said first opening and wherein said second one-way check valve is positioned within said second opening.

16. A hydraulic pump as in claim 10 wherein said bladder moves against said inner wall of said chamber under said relatively high pressure.

17. A hydraulic pump as in claim 10 wherein said bladder is constructed substantially of ethylene propylene.

18. A hydraulic pump as in claim 17 wherein said bladder is constructed substantially of ethylene propylene dimonomer.

19. A hydraulic pump as in claim 10 wherein said relatively high pressure is within the range of five (5) to eighty (80) pounds per square inch.

* * * * *